US010034585B2

(12) United States Patent
Moore et al.

(10) Patent No.: US 10,034,585 B2
(45) Date of Patent: Jul. 31, 2018

(54) PUMPS WITH RESTRICTOR-BASED LOST MOTION

(71) Applicant: GOJO Industries, Inc., Akron, OH (US)

(72) Inventors: Mark W. Moore, Aurora, OH (US); Mark Rosenkranz, Elyria, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 15/224,779

(22) Filed: Aug. 1, 2016

(65) Prior Publication Data

US 2017/0035257 A1 Feb. 9, 2017

Related U.S. Application Data

(60) Provisional application No. 62/201,346, filed on Aug. 5, 2015.

(51) Int. Cl.

| | |
|---|---|
| ***A47K 5/14*** | (2006.01) |
| ***B05B 11/00*** | (2006.01) |
| ***A47K 5/12*** | (2006.01) |
| *A47K 5/16* | (2006.01) |

(52) U.S. Cl.

CPC ..... *A47K 5/14* (2013.01); *A47K 5/1211* (2013.01); *B05B 11/3001* (2013.01); *B05B 11/3005* (2013.01); *B05B 11/3087* (2013.01); *A47K 5/16* (2013.01)

(58) Field of Classification Search

CPC ..... A47K 5/1211; A47K 5/14; A47K 5/16; B05B 11/3001; B05B 11/3005; B05B 11/3087

See application file for complete search history.

(56) References Cited

U.S. PATENT DOCUMENTS

| | | | | |
|---|---|---|---|---|
| 6,612,468 | B2 * | 9/2003 | Pritchett | B05B 7/0037 222/190 |
| 7,802,701 | B2 * | 9/2010 | Jahan | B05B 7/0037 222/153.13 |
| 8,109,415 | B2 * | 2/2012 | Tu | B05B 7/0037 222/145.5 |
| 8,668,116 | B2 * | 3/2014 | Ciavarella | A47K 5/1207 222/153.13 |

(Continued)

*Primary Examiner* — David Angwin
*Assistant Examiner* — Bob Zadeh
(74) *Attorney, Agent, or Firm* — Calfee, Halter & Griswold LLP

(57) ABSTRACT

The present application discloses liquid dispensers, refill units for liquid dispensers, liquid pumps, lost motion devices, and methods for installing a refill unit and lost motion device. In certain embodiments, a liquid dispenser of the present application comprises a container for holding a liquid, a pump housing connected to the container, a liquid or air chamber, and a piston movable in the liquid or air chamber. A connector is linked to the piston. The connector has a flexible portion for connecting to the piston and an attachment portion for attaching to an actuator of the dispenser. A restrictor is positioned between the flexible portion of the connector and the piston. Movement of the connector a first distance in a first direction results in lost motion between the actuator and the piston and continued movement of the connector a second distance in the first direction moves the piston with the actuator.

17 Claims, 7 Drawing Sheets

(56) References Cited

U.S. PATENT DOCUMENTS

| | | | | |
|---|---|---|---|---|
| 8,827,119 | B2 | 9/2014 | Ciavarella et al. | |
| 8,955,718 | B2 * | 2/2015 | Ciavarella | F04B 53/14 222/190 |
| 8,955,769 | B2 * | 2/2015 | Pelfrey | A47K 5/14 222/145.6 |
| 9,616,445 | B2 * | 4/2017 | Ciavarella | F04B 53/14 |
| 9,700,181 | B1 * | 7/2017 | Santoro | A47K 5/1211 |
| 2009/0039111 | A1 * | 2/2009 | Tu | B05B 7/0037 222/190 |
| 2010/0059550 | A1 * | 3/2010 | Ciavarella | A47K 5/1207 222/325 |
| 2012/0285992 | A1 | 11/2012 | Ciavarella | |
| 2012/0308405 | A1 | 12/2012 | McNulty et al. | |
| 2013/0037573 | A1 | 2/2013 | Spiegelberg et al. | |
| 2013/0292410 | A1 | 11/2013 | Pelkey | |
| 2014/0054322 | A1 * | 2/2014 | McNulty | A47K 5/14 222/190 |
| 2014/0117053 | A1 | 5/2014 | Ciavarella | |
| 2017/0035257 | A1 * | 2/2017 | Moore | A47K 5/1211 |

* cited by examiner

PUMPS WITH RESTRICTOR-BASED LOST MOTION

RELATED APPLICATIONS

This application claims priority to and the benefits of U.S. Patent Application Ser. No. 62/201,346, filed on Aug. 5, 2015 and titled PUMPS WITH RESTRICTOR-BASED LOST MOTION, and which is incorporated herein by reference in its entirety.

BACKGROUND OF THE INVENTION

Liquid dispenser systems, such as liquid soap and sanitizer dispensers, provide a user with a predetermined amount of liquid upon actuation of the dispenser. In addition, it is sometimes desirable to dispense the liquid in the form of foam by, for example, injecting air into the liquid to create a foamy mixture of liquid and air bubbles by use of an air pump or air compressor. Most foam pumps have a constant volume output and to change the volume requires one to change the pump or "short stroke" the pump. A foam pump is short stroked when a user rapidly pushes a dispense actuator and the pump does not have time to move back to it rest position, or the dispenser or a user prevents the actuator from returning to its full stroke before actuating the actuator an additional time.

SUMMARY

The present application discloses liquid dispensers, refill units for liquid dispensers, liquid pumps, lost motion devices, and methods for installing a refill unit and lost motion device.

In certain embodiments, a liquid dispenser of the present application comprises a container for holding a liquid, a pump housing connected to the container, a liquid or air chamber, and a piston movable in the liquid or air chamber. A connector is linked to the piston. The connector has a flexible portion for connecting to the piston and an attachment portion for attaching to an actuator of the dispenser. A restrictor is positioned between the flexible portion of the connector and the piston. Movement of the connector a first distance in a first direction results in lost motion between the actuator and the piston and continued movement of the connector a second distance in the first direction moves the piston with the actuator. In some embodiments, the liquid dispenser has a foam pump comprising a container for holding a foamable liquid, a liquid chamber, a liquid piston movable in the liquid chamber, an air chamber, and an air piston movable in the air chamber and linked to the liquid piston. In these embodiments, movement of the connector the first distance in the first direction results in lost motion between the actuator and the liquid piston and the air piston.

In certain embodiments, a foam pump of the present application comprises a liquid piston for a liquid pump, an air piston for an air pump linked to the liquid pump, a connector for linking the liquid and air pistons to an actuator, and a restrictor positioned between a flexible portion of the connector and the liquid and air pistons. When installed in a foam dispenser, the stroke of the actuator is greater than the stroke of the liquid piston and the air piston producing less than a full dose of foam.

In certain embodiments, a lost motion device of the present application comprises a connector and a restrictor. The connector is configured to link to an air piston or a liquid piston of a foam pump. The connector has a flexible portion for connecting to the piston of the foam pump and an attachment portion for attaching to an actuator of a foam dispenser. The restrictor is capable of being positioned between the flexible portion of the connector and the piston of the foam pump. Movement of the connector a first distance in a first direction results in lost motion between the actuator and the liquid piston and the air piston and continued movement of the connector a second distance in the first direction moves the liquid piston and the air piston with the actuator.

These and additional embodiments will become apparent in the course of the following detailed description.

BRIEF DESCRIPTION OF THE DRAWINGS

In the accompanying drawings which are incorporated in and constitute a part of the specification, embodiments of the invention are illustrated, which, together with a general description of the invention given above, and the detailed description given below, serve to example the principles of the inventions.

DETAILED DESCRIPTION

The present application discloses exemplary embodiments of liquid dispensers, liquid pumps and refill units that may be configured to provide different dosages of liquid to the user (e.g., foam). For example, in certain embodiments, a restrictor is used to convert a pump from providing a full dose to a partial dose to the user. The amount of the partial dose may be adjusted based on the size, shape and configuration of the restrictor used. Further, removal of the restrictor converts the pump back to providing a full dose.

When the pumps of the present application dispense the liquid as a foam, the pump generally comprises a liquid pump having a liquid piston and an air pump having an air piston that is linked to the liquid pump. A connector generally links the liquid and air pistons to an actuator. A restrictor is positioned between a portion of the connector and the liquid and air pistons. When installed in a dispenser, the stroke of the actuator is greater than the stroke of the liquid piston and the air piston producing less than a full dose of foam.

A foam dispenser of the present application generally includes a housing for receiving a refill unit and an actuator for driving the foam pump of the refill unit and causing the dispenser to dispense foam. The refill unit generally comprises a container for holding a liquid, a pump housing connected to the container, a liquid and/or air chamber, and a piston movable in the liquid and/or air chamber. The dispenser comprises a connector that links to the piston. The connector has a first portion for connecting to the piston and a second portion for attaching to the actuator of the dispenser. A restrictor is positioned between the first portion of the connector and the piston. In certain embodiments, the restrictor may be included as part of the refill unit. Movement of the connector (with the restrictor in place) a first distance in a first direction results in lost motion between the actuator and the piston. Further, continued movement of the connector a second distance in the first direction moves the piston with the actuator.

Figure 1:
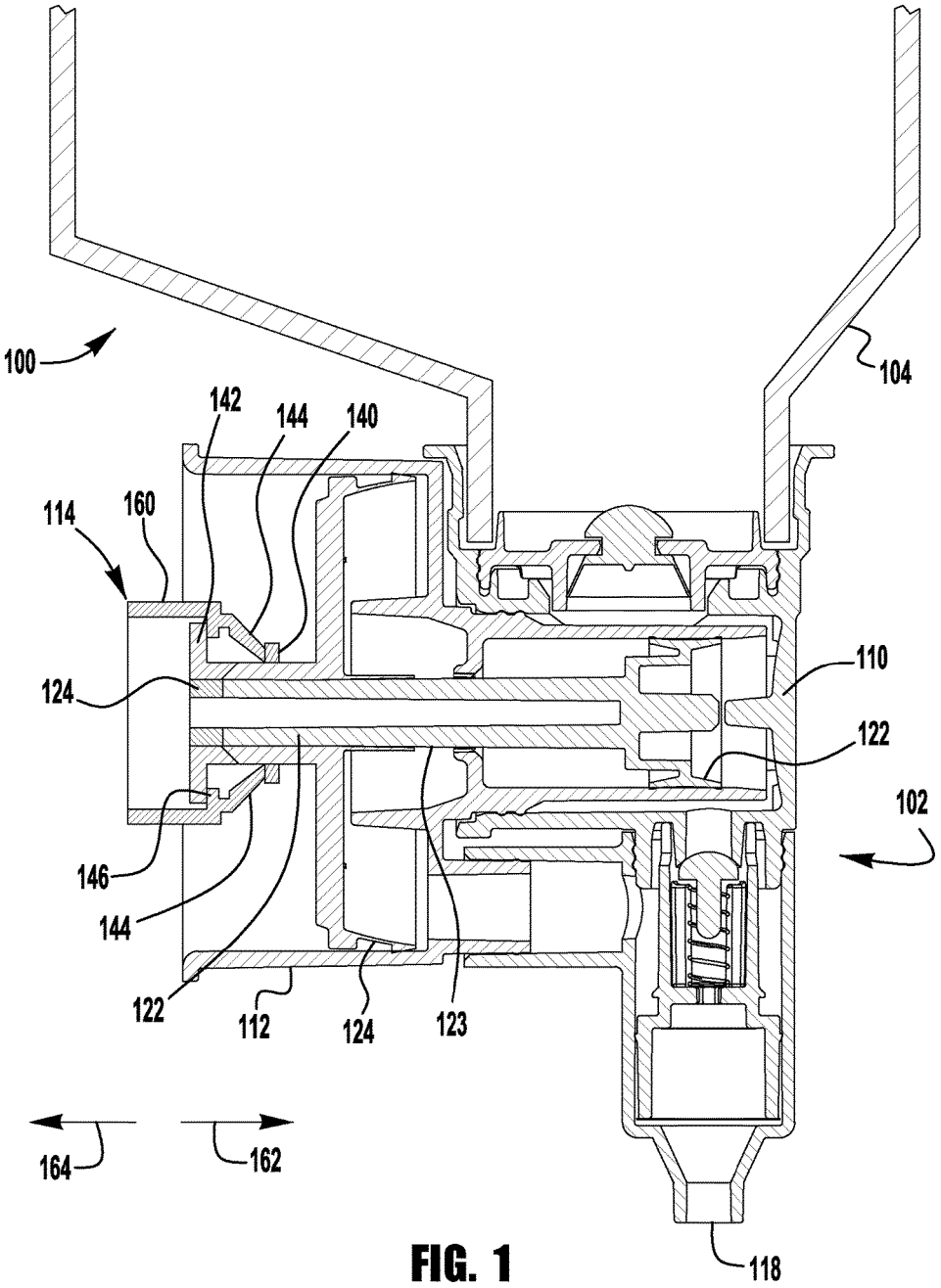
FIG. 1 is side cross sectional view illustrating a refill unit having a connector according to an embodiment of the present application.

FIG. 1 illustrates an exemplary embodiment of a refill unit 100 for a foam dispenser. As shown, refill unit 100 includes a container 104 and a foam pump 102. Foam pump 102 includes an air pump portion 112, a liquid pump portion 110, and a foam outlet 118. A connector 114 of the foam dispenser links a liquid piston 122 of liquid pump portion 110 and an air piston 124 of air pump portion 112 to the actuator (not shown) of the foam dispenser. Liquid piston 122 includes a shaft 123 that engages with air piston 124 to connect the liquid piston to the air piston. Thus, movement of the actuator moves the liquid and air pistons causing the dispenser to dispense foam. In certain embodiments, the connector may be configured to link only one of the air and liquid pistons to the actuator. Further, the connector and the actuator may be integrally formed or separate components that connect or otherwise interface to move one or more pistons of the foam pump. In certain embodiments, the connector may be included as part of the refill unit.

FIGS. 3A-5B illustrate exemplary connectors 314 and 414 according to embodiments of the present application. As shown by these embodiments, the connectors of the present application may have a hemispherical, U-shaped, or other open shaped body portion that permits the connector to at least partially surround and connect to one or more pistons of the foam pump. Further, the connectors of the present application may have a plurality of flexible fingers or members extending from the body portion that facilitate connection to the piston. The members are flexible in that they are configured to flex slightly (e.g., between about 10° and about 15° inward and outward relative to a longitudinal axis of the connector). However, the flexible fingers or members are substantially rigid such that they are capable of pushing against a projection of the piston and moving the piston when the connector and actuator are moved. Connectors 314 and 414 are discussed further below.

As shown in FIG. 1, connector 114 also includes an open shaped body portion 160 and a plurality of flexible fingers or members 144 extending from the body portion that facilitate connection of the connector to pistons 122 and 124 of foam pump 102. As shown in this embodiment, connector 114 links to air piston 124 and liquid piston 122 moves with air piston 124. Air piston 124 includes annular projections 140 and 142 that are used to link connector 114 to the air piston. For example, when connector 114 is connected to air piston 124, flexible members 144 are located behind annular projection 140 such that the ends of the flexible members contact the projection and move the air piston in a first direction 162 with the connector to dispense the foam. Similarly, a lip portion 146 of connector 114 is located in front of annular projection 142 such that the lip portion contacts the projection and moves the air piston in a second direction 164 with the connector to charge foam pump 102. In other embodiments, connector 114 may be configured to link to the liquid piston or both the liquid piston and air piston of the foam pump. Further, in certain embodiments, flexible members 144 are not formed of multiple fingers, but rather a flexible one-piece member that moves relative to body portion 160 and latches onto the piston.

To install refill unit 100, the refill unit is lowered so that annular projection 140 of air piston 124 is located in front of the end of flexible members 144 as shown in FIG. 1. When refill unit 100 is moved into position, flexible members 144 flex outward and put pressure on air piston 124. Flexible members 144 do not return to an unflexed position when refill unit 100 is installed in the dispenser and maintain pressure on air piston 124. If refill unit 100 is installed in the dispenser and annular projection 140 is not located in front of flexible members 144 as shown in FIG. 1, the first time connector 114 moves to engage foam pump 102, the flexible members expand to allow annular projection 140 to pass by the ends of the flexible members. Once annular projection 140 moves past the end of flexible members 144, the flexible members snap down on air piston 124 in front of annular projection 140 and lip portion 146 of connector 114 contacts annular projection 142. As such, connector 114 is linked to air piston 124. Refill unit 100 may be disengaged from connector 114 by lifting the refill unit 100 upward.

A foam dispenser for use with the embodiments described herein generally includes a housing for receiving refill unit 100 and an actuator for driving the foam pump and causing the dispenser to dispense foam. The actuator is generally movably connected to the housing such that the actuator may be moved relative to the housing to actuate the dispenser. The actuator may be manually or electrically operated. In some embodiments, the housing encloses container 104 and foam pump 102. In such embodiments, container 104 may be a collapsible container that collapses when the foamable liquid is removed. In some embodiments, the housing encloses only a portion of refill unit 100. In such embodiments, container 104 may be vented so that it does not collapse when the foamable liquid is removed.

The actuator pushes connector 114 inward to dispense the foam. During this forward stroke, flexible members 144 of connector 114 push against a surface of projection 140 to move air piston 124 and liquid piston 122 inward to dispense a dose of foam. The actuator then moves connector 114 outward to charge the foam pump. During this return stroke, lip portion 146 of connector 114 pushes against projection 142 to move air piston 124 and liquid piston 122 outward to charge the air and liquid chambers. When no restrictor is used, liquid piston 122 and air piston 124 move with the actuator the entire forward distance to the end of the foam pump stroke and the entire return distance back to the beginning of the foam pump stroke. Thus, without a restrictor, the entire stroke length is utilized and a full dose of foam is delivered to the user.

Figure 2:
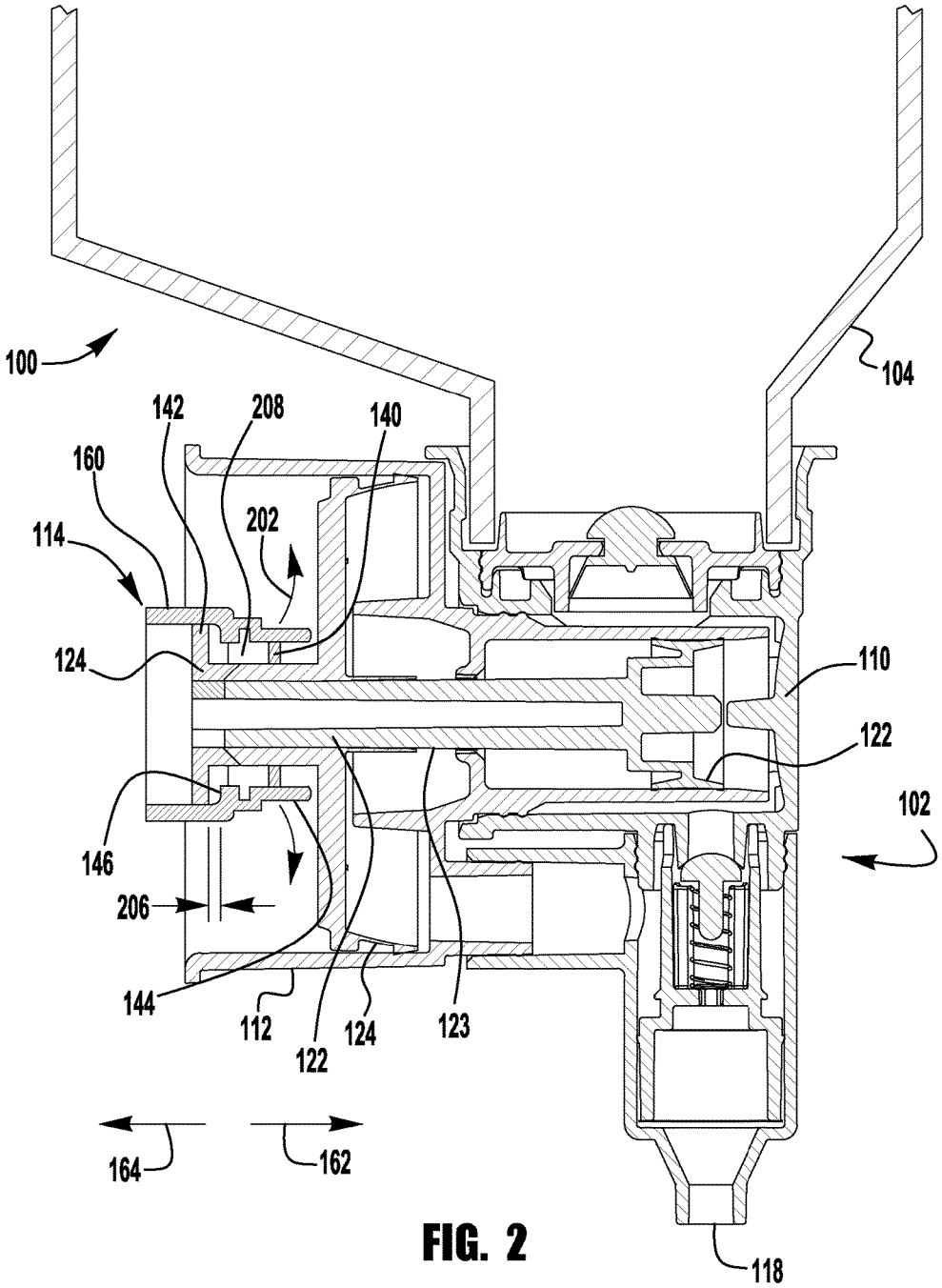
FIG. 2 is side cross sectional view of the refill unit of FIG. 1 having a restrictor according to an embodiment of the present application.

FIG. 2 illustrates refill unit 100 with a restrictor 208 installed according to an embodiment of the present application. As shown, restrictor 208 engages connector 114 such that it moves with the connector and is positioned between flexible members 144 and air piston 124. Restrictor 208 forces flexible members 144 in a direction outward 202 such that the ends of the members no longer contact annular projection 140. As such, restrictor 208 permits connector 114 to move relative to air piston 124 and parallel to the movement of the air piston during operation of the dispenser. As shown in FIG. 2, restrictor 208 pushes against annular projection 140 to move air piston 124 in first direction 162 to dispense the foam. Restrictor 208 is sized and shaped such that a gap 206 exists between lip portion 146 and projection 142. Further, although not shown in FIG. 2, when connector 114 moves outward to charge foam pump 102, lip portion 146 and/or restrictor 208 pushes against projection 142 and moves air piston 124 in second direction 164 and gap 206 forms between restrictor 208 and projection 140.

For example, during actuation, an actuator pushes connector 114 and restrictor 208 inward until the restrictor contacts projection 140. Once restrictor 208 contacts projection 140, air piston 124 and liquid piston 122 move with connector 114 the remainder of the forward stroke. Thus, a first portion of the distance moved by connector 114 during the forward stroke does not move air piston 124 or liquid piston 122, resulting in "lost motion." This first distance is created by gap 206 which provides lost motion between air and liquid pistons 122 and 124 and the actuator. Similarly, during the return stroke, the actuator moves connector 114 outward until lip portion 146 and/or restrictor 208 contacts projection 142. Once lip portion 146 and/or restrictor 208 contacts projection 142, air piston 124 and liquid piston 122 move with connector 114 the remainder of the return stroke. Thus, a first portion of the distance moved by connector 114 during the return stroke also does not move air piston 124 or liquid piston 122, resulting in "lost motion" as well. This lost motion between air and liquid pistons 122 and 124 and the actuator produces less than a full dose of foam to the user.

As described herein, the lost motion may be adjusted to vary the output dose by, for example, adjusting the width of the gap created by the restrictor. For example, the shape, size, configuration, and/or position of the restrictor may be varied to adjust the width of the gap created by the restrictor. Thus, the width of gap may be varied to arrive at a desired lost motion. Further, the lost motion may be adjusted to obtain any output dose that is a percentage of a full dose such as, for example, 90%, 80%, 70%, 60%, 50% or any other percentage of a full dose.

As shown in FIG. 2, the lost motion occurs during both the forward and return stroke of foam pump 102, i.e., the lost motion is in both the charging direction (return) and dispensing direction (forward). However, in certain embodiments, the connector and restrictor may be configured such that lost motion occurs in only one direction. For example, the connector and restrictor may be configured such that the pump piston always moves to its end of stroke length but does not return to the beginning of its stroke length, i.e., the lost motion is in the charging direction, not the pump dispensing direction.

In some embodiments, the connector (e.g., connector 114) is formed as part of the actuator and a separate connector need not be used. Many different types of connectors may be used to connect the actuator to the foam pump that results in lost motion of the liquid piston and/or air piston. Several additional exemplary embodiments are disclosed below.

In addition, in some embodiments, the lost motion occurs between the actuator and either the liquid or air pistons, so that, for example, there is no lost motion between the actuator and the air piston, but there is lost motion with respect to the liquid piston. In some embodiments, the lost motion occurs between the liquid piston and the air piston. In various embodiments, the lost motion occurs between any combination of the linkage to the actuator, the linkage to the air piston or the linkage to the liquid piston.

Figure 3A:
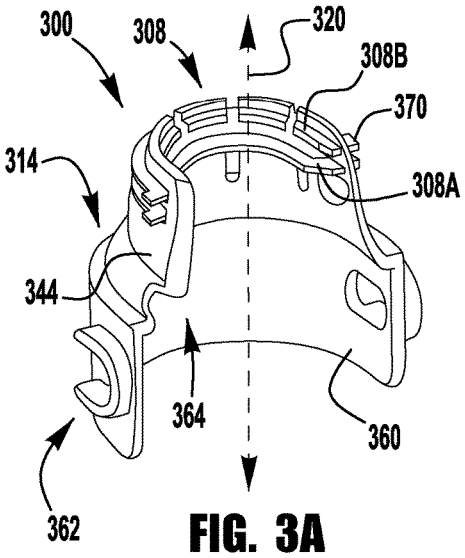
FIGS. 3A and 3B are perspective views illustrating a lost motion device according to an embodiment of the present application.
Figure 3B:
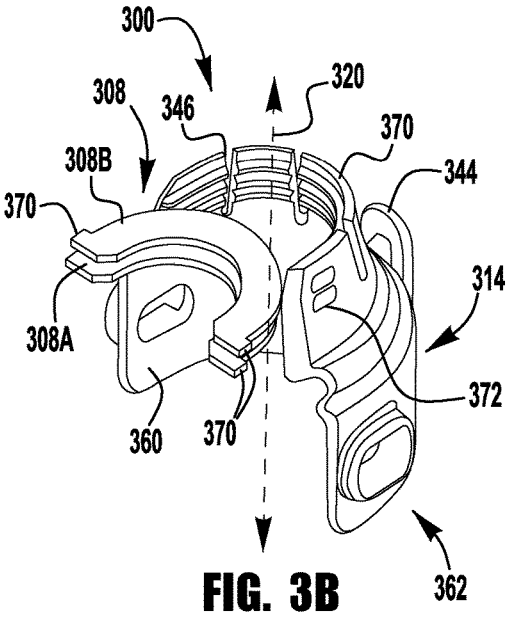

FIGS. 3A and 3B illustrate a lost motion device 300 having a connector 314 and restrictor 308 according to an embodiment of the present application. Restrictor 308 comprises first and second restrictor plates 308*a* and 308*b*. FIG. 3A illustrates connector 314 with restrictor 308 installed and FIG. 3B illustrates the connector with the restrictor removed. As shown, connector 314 includes a hemispherical or U-shaped body 360 formed about a longitudinal axis 320 of the connector. Body 360 comprises an attachment portion 362 for attachment to the actuator and a lip portion 364 for connection to the piston. Connector 314 also comprises a plurality of flexible fingers or members 344 extending outward from an end of body 360. As shown in FIG. 3B, flexible members 344 extend inward toward longitudinal axis 320 when in the relaxed condition with restrictor 308 removed. As such, flexible members 344 contact the piston shaft and the ends of the members contact the projection of the piston when connector 314 is attached to the piston without restrictor 308.

As shown in FIGS. 3A and 3B, flexible members 344 of connector 314 comprise protrusions or ridges forming a plurality of slots 346 on the interior of the members at various locations relative to body 360 of the connector. Slots 346 hold restrictor plates 308*a* and 308*b* in place and permit the restrictor plates to be placed at various distances relative to the ends of flexible members 344. As shown in FIG. 3B, the two U-shaped restrictor plates 308*a* and 308*b* are inserted into two slots 346 of connector 314 to flex members 344 outward as described above with reference to FIG. 2. Flexible members 344 press against restrictor plates 308*a* and 308*b* to hold the plates in place relative to connector 314. Additionally, protrusions 370 extending from restrictor plates 308*a* and 308*b* mate with either openings 372 in flexible members 344 and/or spaces between the flexible members to facilitate holding the plates in place relative to the connector.

The distance between a top surface of restrictor 308 and the ends of flexible members 344 forms a gap that acts like gap 206 described above with reference to FIG. 2. As discussed, the width of gap 206 represents the amount of lost motion provided by the combination of connector 114 and restrictor 208. Thus, the amount of lost motion provided by lost motion device 300 is the distance between the top surface of restrictor 308 and the ends of flexible members 344. As shown in FIGS. 3A and 3B, restrictor plates 308*a* and 308*b* may be inserted in any of slots 346 formed on the interior of flexible members 344. Further, only one restrictor plate 308*a* or 308*b* is needed to create a gap and thus lost motion. For example, as restrictor plate 308*a* or 308*b* is positioned in slots 346 further from the ends of flexible members 344, the width of the gap increases and so does the amount of lost motion. As such, lost motion device 300 is adjustable in that connector 314 and restrictor 308 may be arranged in multiple ways to provide varying amounts of lost motion and thus dosages of foam to the user. Connector 314 may have any number of slots 346 to provide any number of potential dosages of foam.

Figure 4A:
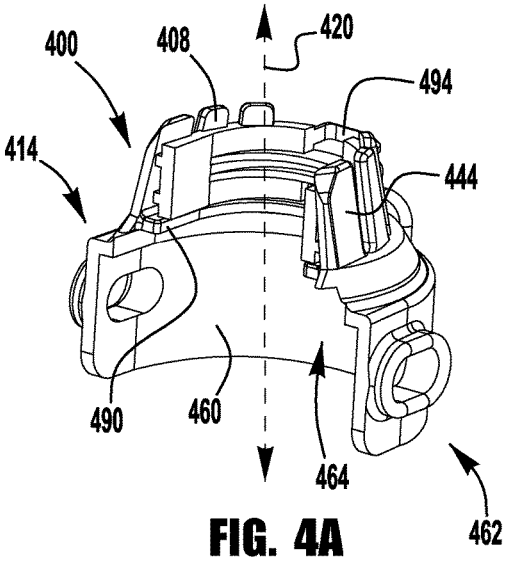
FIGS. 4A-4E are perspective, top, rear, and side views illustrating a lost motion device according to an embodiment of the present application.
Figure 4B:
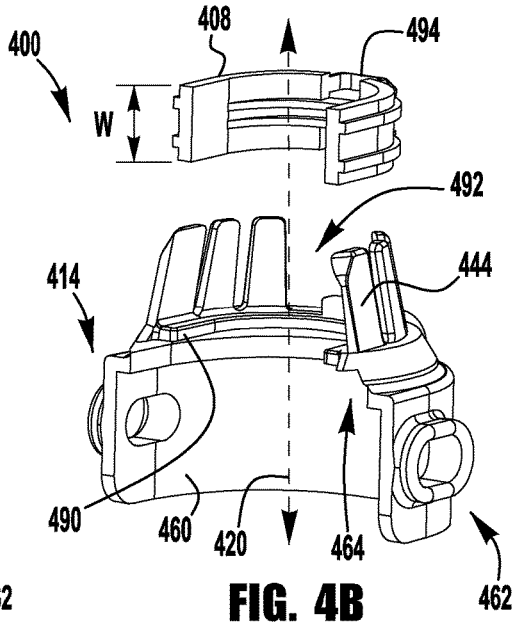
Figure 4C:
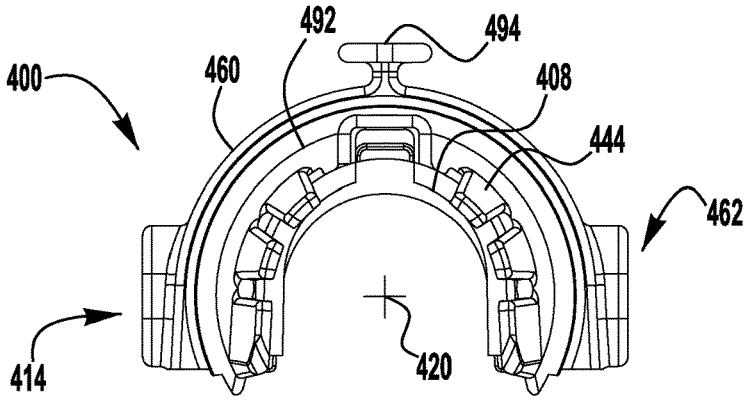
Figure 4D:
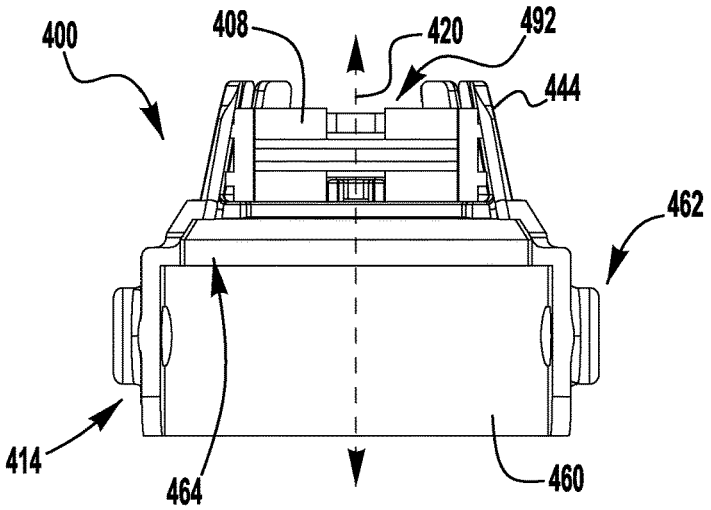
Figure 4E:
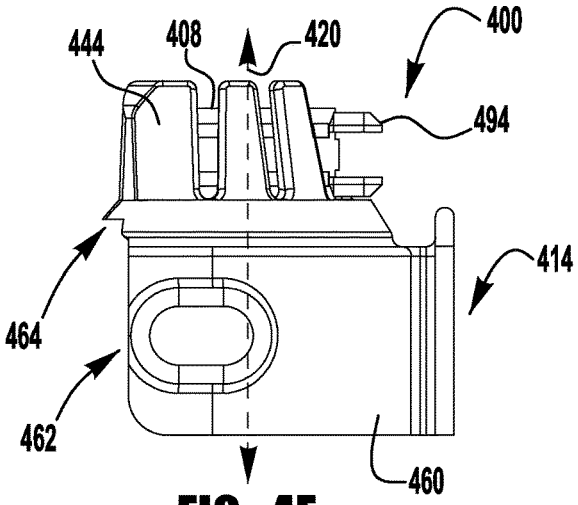

FIGS. 4A-4E illustrate a lost motion device 400 having a connector 414 and restrictor 408 according to an embodiment of the present application. FIGS. 4A and 4C-4E illustrate connector 414 with restrictor 408 installed and FIG. 4B illustrates the connector with the restrictor removed. As shown, connector 414 also includes a hemispherical or U-shaped body 460 formed about a longitudinal axis 420 of the connector. Body 460 comprises an attachment portion 462 for attachment to the actuator and a lip portion 464 for connection to the piston. Connector 414 also comprises a plurality of flexible fingers or members 444 extending outward from an end of body 460. As shown in FIG. 4B, flexible members 444 extend inward toward longitudinal axis 420 in the relaxed condition with restrictor 408 removed for connection to the pump piston.

As shown in FIGS. 4A and 4B, the body 460 of connector 414 comprises a protrusion or ridge 490 that facilitates installation and positioning of restrictor 408. Flexible members 444 of connector 414 press against restrictor 408 to hold the restrictor in place relative to the connector. Additionally, a central opening 492 between flexible members 444 permits one or more portions of restrictor 408 to extend outward between the members and/or through the central opening. As shown in FIGS. 4A-4E, restrictor 408 comprises upper and lower tabs or protrusions 494 that extend between flexible members 444 and through central opening 492. Tabs 494 are accessible and facilitate placement and removal of restrictor 408 within connector 414. Tabs 494 may also be configured to prohibit movement of restrictor 408 relative to connector 414. For example, tabs 494 may be configured to mate with body 460 of connector 414, such as a member or protrusion extending upward from the body. Tabs 494 may also be shaped and sized to contact flexible members 444 to prohibit movement of restrictor 408 relative to connector 414.

The distance between the top surface of restrictor 408 and the ends of flexible members 444 is the width of the gap described above, which is the amount of lost motion provided by lost motion device 400. Thus, varying the width W of the restrictor used varies the amount of lost motion and dosage provided to the user. For example, thinner restrictors provide for more lost motion and less amount of foam with each dosage while thicker restrictors provide for less lost motion and greater amount of foam with each dosage. Any number of restrictors having various thicknesses may be used to provide varying amounts of lost motion and thus dosages of foam to the user. Further, the restrictor may have an adjustable thickness such that the amount of foam delivered with each dosage can be adjusted by the user.

If the lost motion restrictors of the present application are removed from the pump, the connectors of the present application will revert back to providing a full dosage of liquid to the user. This is a beneficial feature because users often try and remove foam pump actuators in the field to modify the amount of dosage. If the actuator breaks or cannot be re-installed, the foam pump does not pump and the dispenser does not work. Here, the connectors of the present application are configured to facilitate installation and removal of the restrictor and attachment to the actuator. As such, the foam pump can be easily modified by the user to provide various dosages of liquid to the user.

In some embodiments, the exemplary foam dispensers or refill units may be shipped with multiple lost motion restrictors. A user may decide which restrictor to use based upon the desired output. For example, the user may choose to not use a restrictor and the refill unit will output a full dose. A first lost motion restrictor could result in a first reduced dose output and a second lost motion restrictor could result in a second reduced dose. Thus, the user could decide which lost motion restrictor to use. In addition, the restrictor may be configured to connect to the pump piston, and be movable relative thereto, and interface with the connector to provide lost motion. For example, the restrictor may be formed as a partial ring or other member that connects to the piston.

The connectors and restrictors of the present application may be used with a wide variety of pumps and dispensers including a variety of horizontal and vertical liquid pumps and foam pumps. For example, many of the components of the pump may be substantially similar to the embodiments of pumps disclosed in U.S. Pat. No. 8,827,119 titled "Pull Pumps, Refill Units and Dispensers for Pull Pumps" and U.S. Publication Nos. 2012/0285992 titled "Foam Pump," 2012/0308405 titled "Modular Pump," and 2013/0037573 titled "Split Body Pumps"for Foam Dispensers and Refill Units, all of which are incorporated herein by reference in their entirety. Detailed operation of liquid and foam pumps may be understood by referring to these applications. Embodiments of these pumps, as well as other liquid pumps and foam pumps may be modified to be lost motion pumps using the connectors and restrictors of the present application.

Figure 5B:
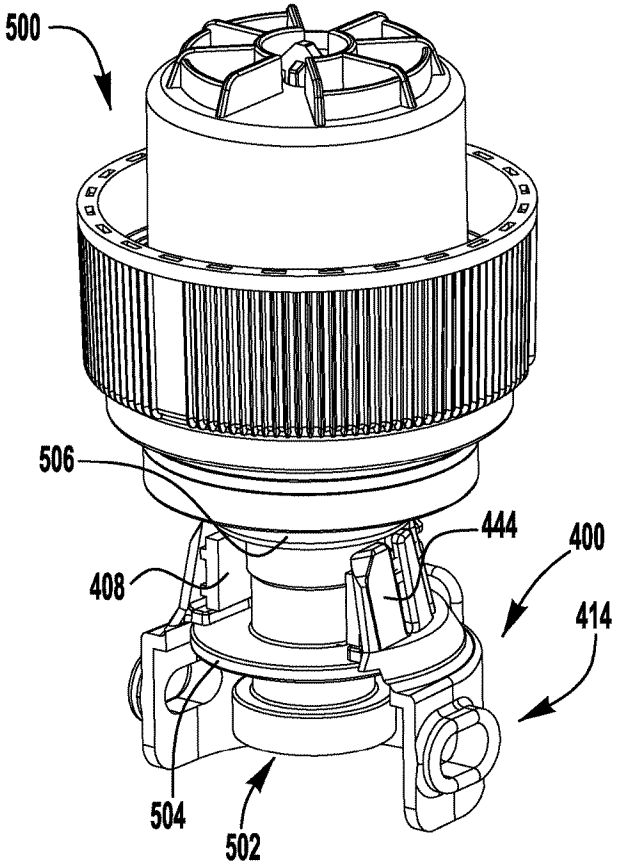
FIGS. 5A and 5B are perspective views of a foam pump illustrating installation of the lost motion device shown in FIGS. 4A-4E.
Figure 5A:
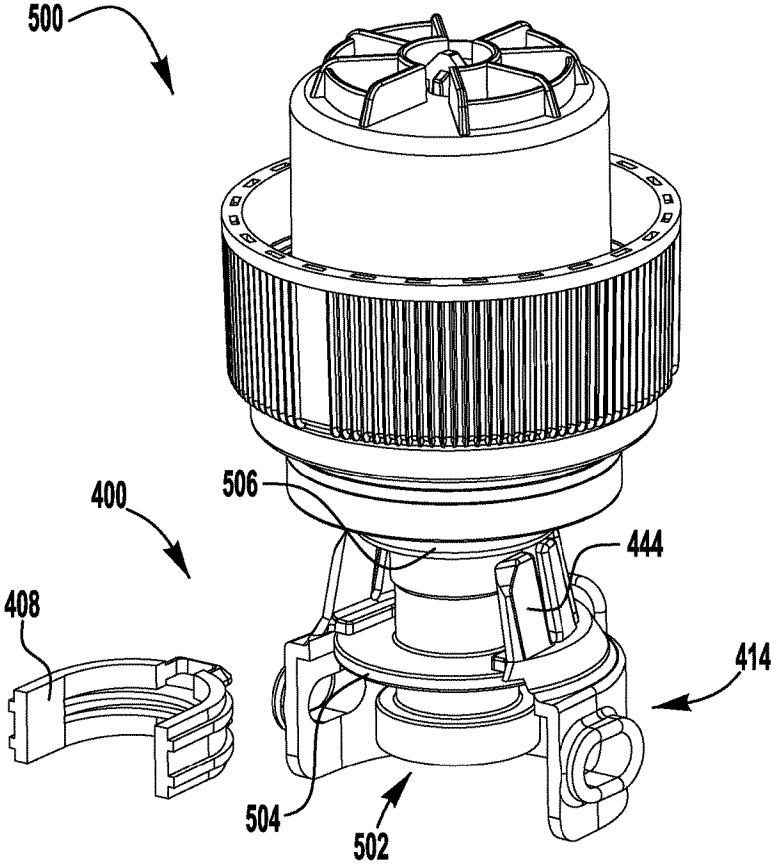

FIGS. 5A and 5B illustrate lost motion device 400 used with a vertical pump 500. FIG. 5A illustrates connector 414 connected to a piston 502 of vertical pump 500 without restrictor 408 and with the flexible members 444 bent inward toward the pump. FIG. 5B illustrates connector 414 connected to piston 502 of vertical pump 500 with restrictor 408 installed and flexible members 444 substantially straight or substantially parallel with the longitudinal axis of the connector. As shown, connector 414 connects to piston 502 of vertical pump 500. Piston 502 comprises annular projections 504 and 506. Lip portion 464 of connector 414 pushes against projection 504 to move piston 502 downward (charging the pump) and the ends of flexible members 444 push against projection 506 to move the piston upward (discharging the pump and dispensing the material). As shown in FIG. 5B, restrictor 408 is installed between flexible members 444 and piston 502 creating a gap 510 between the restrictor and projection 506 and lost motion. As such, vertical pump 500 provides less than a full dosage of material to the user.

As illustrated by FIGS. 5A and 5B, installation of restrictor 408 includes removing pump 500 from connector 414 and positioning the restrictor around piston 502. Piston 502 and restrictor 408 are then inserted into connector 414 such that the restrictor is positioned between the connector and the piston.

Figure 6A:
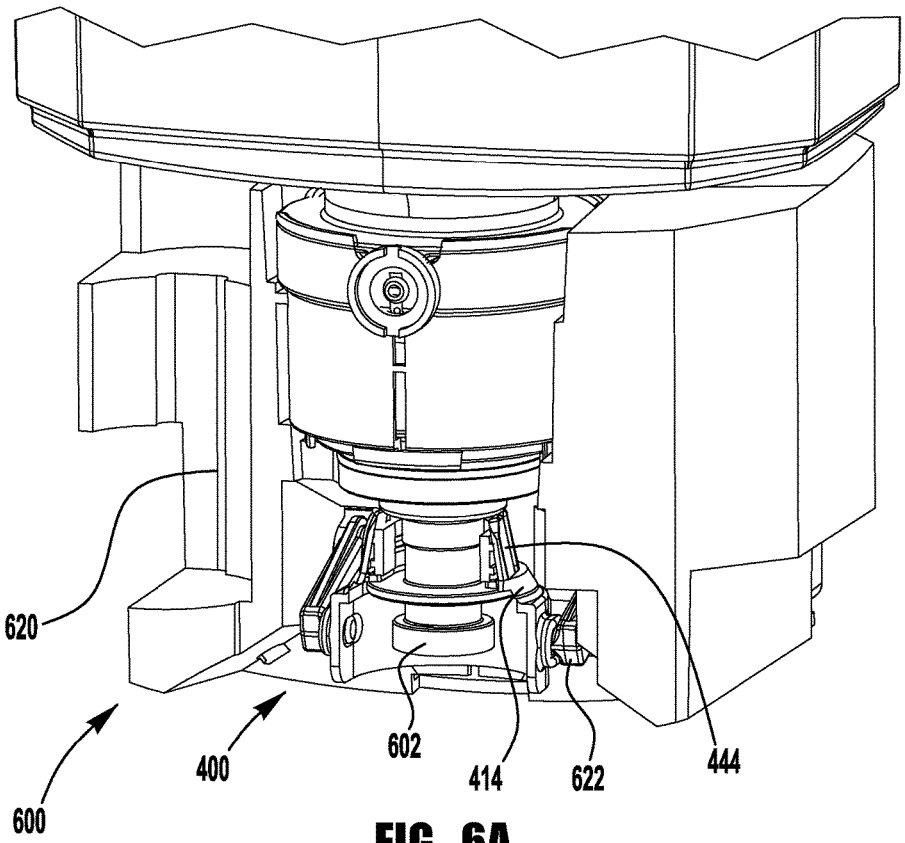
FIGS. 6A and 6B are perspective views of a foam dispenser having the lost motion device shown in FIGS. 4A-4E.
Figure 6B:
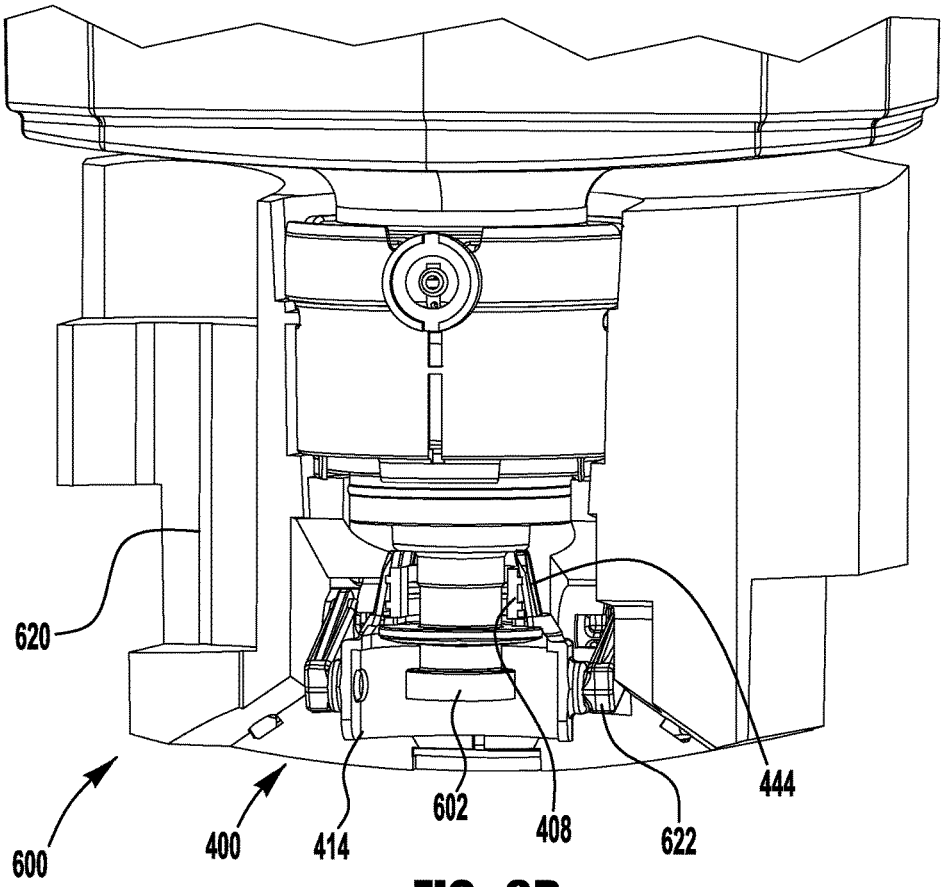

FIGS. 6A and 6B illustrate lost motion device 400 connected to an actuator 622 of a foam dispenser 600 having housing 620. FIG. 6A illustrates connector 414 connected to a piston 602 of foam dispenser 600 without restrictor 408 and with the flexible members 444 bent inward toward the pump. FIG. 5B illustrates connector 414 connected to piston 602 of foam dispenser 600 with restrictor 408 installed and flexible members 444 substantially straight or substantially parallel with the longitudinal axis of the connector. As shown, connector 414 connects to piston 602 of foam dispenser 600. Movement of actuator 622 downward moves connector 414 and piston 602 downward (charging the pump). Movement of actuator 622 upward moves connector 414 and piston 602 upward (discharging the pump and dispensing the material). The actuator 622 may be manually or electrically operated. As shown in FIG. 6B, restrictor 408 is installed between flexible members 444 and piston 602 creating a gap between the restrictor and the piston projection and lost motion. As such, foam dispenser 600 provides less than a full dosage of material to the user.

Although the embodiments shown and described herein contain piston pumps, exemplary embodiments of the connectors and restrictors may be used to create lost motion in other pumps, such as dome pumps, bellows pumps and the like. In such cases, the connector and restrictors engage a mechanism that in turn actuates the pump, such as the dome or bellow of the pump, creating lost motion and reduced dosage of material to the user.

The dispensers of the present application may be manually operated or electrically operated. For example, in certain embodiments, a foam dispenser includes an actuator drive rotated by an electric motor about an axis. In operation, a sensor detects an object and causes the actuator drive to rotate moving the actuator and connector inward. Movement of the connector inward forces liquid out of liquid pump chamber and air out of the air chamber. The liquid and air are mixed together in a mixing chamber and are forced through a mix media, which may be a mixing cartridge, screens, sponge, baffles or the like, and out of an outlet in the form of a foam. At the end of the stroke, the actuator drive rotates the actuator back to its rest position and also expands the air chamber and liquid chamber by moving the air piston and liquid piston back to a partially charged state. The air chamber and the liquid chamber are moved back to a partially charged state because of the lost motion caused by the connector and restrictor. Again, the percentage of the charge volume may be adjusted by simply changing the configuration of the restrictor as discussed above.

As described herein, when one or more components are described as being connected, joined, affixed, coupled, attached, linked, or otherwise interconnected, such interconnection may be direct as between the components or may be indirect such as through the use of one or more intermediary components. Also as described herein, reference to a "member," "connector", "component," or "portion" shall not be limited to a single structural member, component, or element but can include an assembly of components, members or elements.

While the present invention has been illustrated by the description of embodiments thereof, and while the embodiments have been described in considerable detail, it is not the intention of the applicants to restrict or in any way limit the scope of the invention to such details. Additional advantages and modifications will readily appear to those skilled in the art. For example, where components are releasably or removably connected or attached together, any type of releasable connection may be suitable including for example, locking connections, fastened connections, tongue and groove connections, etc. Still further, component geometries, shapes, and dimensions can be modified without changing the overall role or function of the components. Therefore, the inventive concept, in its broader aspects, is not limited to the specific details, the representative apparatus, and illustrative examples shown and described. Accordingly, departures may be made from such details without departing from the spirit or scope of the applicant's general inventive concept.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

We claim:

1. A foam dispenser, comprising:

a container for holding a liquid;

a pump housing connected to the container;

a liquid or air chamber;

a piston movable in the liquid or air chamber;

an actuator for driving the piston;

a connector linked to the piston and the actuator, wherein the connector has a flexible portion for connecting to the piston and an attachment portion for attaching to the actuator;

a removable restrictor for positioning between the flexible portion of the connector and the piston;

wherein when the removable restrictor moves the flexible portion of the connector away from the attachment portion to allow lost motion with respect to the connector and the piston;

wherein movement of the connector with the removable restrictor in place a first distance in a first direction results in the lost motion between the connector and the piston; and wherein continued movement of the connector a second distance in the first direction moves the piston with the actuator.

2. The foam dispenser of claim 1, wherein the connector has a U-shaped body comprising the attachment portion and a lip portion for connection to the piston, and wherein the flexible portion extends outward from an end of the U-shaped body.

3. The foam dispenser of claim 2, wherein the lip portion of the U-shaped body pushes against a first projection of the piston to move the piston in a first direction when the connector is linked to the piston and the restrictor is not positioned between the flexible portion of the connector and the piston.

4. The foam dispenser of claim 3, wherein the flexible portion comprises a plurality of flexible members that extend inward and towards the piston when the connector is linked to the piston without the restrictor in place, and wherein the connector pushes against a second projection of the piston to move the piston in a second direction when the connector is linked to the piston without the restrictor in place.

5. The foam dispenser of claim 4, wherein the flexible members comprises at least one slot formed on an interior of the flexible members, and wherein the restrictor comprises at least one plate inserted in the slot of the flexible members.

6. The foam dispenser of claim 1, wherein the restrictor is U-shaped and positioned between a first and second projection of the piston.

7. The foam dispenser of claim 6, wherein a gap is formed between the restrictor and at least one of the first and second projections to create the lost motion between the actuator and the piston, and wherein a width of the gap is a distance between the restrictor and an end of the flexible portion.

8. The foam dispenser of claim 7, wherein the distance between the restrictor and the end of the flexible portion is adjustable to adjust an amount of the lost motion.

9. The foam dispenser of claim 1, wherein the lost motion resolves in an output dose that is at least one of 90%, 80%, 70%, 60%, and 50% of a full dose.

10. The foam dispenser of claim 1 further comprising two or more different restrictors that are to change in output volume of the foam dispenser.

11. A refill unit for a foam dispenser, comprising:

a container for holding a foamable liquid;

a pump housing connected to the container;

a liquid chamber;

a liquid piston movable in the liquid chamber;

an air chamber;

an air piston movable in the air chamber, wherein the air piston is linked to the liquid piston; and a restrictor configured to connect to one of the liquid and the air pistons;

the restrictor located in a position such that when the restrictor is connected to one of the air and liquid pistons, the restrictor deflects a flexible portion of a connector of an actuator when the refill unit is placed in a dispenser;

wherein when the refill unit is installed in the dispenser with the restrictor deflecting the flexible portion of the connector, movement of the connector a first distance in a first direction to result in lost motion between the actuator and the liquid piston and the air piston, and wherein continued movement of the connector a second distance in the first direction moves the liquid piston and the air piston with the actuator.

12. The refill unit of claim 11 further comprising a connector configured to be linked to the air piston or the liquid piston and the actuator, wherein the connector has a flexible portion for connecting to the piston and an attachment portion for attaching to the actuator.

13. A foam dispenser, comprising:

a container for holding a liquid;

a pump housing connected to the container;

the pump housing having a liquid chamber and an air chamber;

a piston movable in the liquid and a piston movable in the air chamber;

an actuator for driving the pistons;

a connector linked to at least one of the pistons and linked to the actuator, wherein the connector has a flexible portion for connecting to at least one of the pistons and an attachment portion for attaching to the actuator;

a removable restrictor for positioning between the flexible portion of the connector and the at least one of the pistons;

wherein the removable restrictor moves the flexible portion of the connector away from the attachment portion to allow lost motion with respect to the connector and the at least one of the pistons;

wherein movement of the connector with the removable restrictor in place a first distance in a first direction results in lost motion between the actuator and the at least one of the pistons; and wherein continued movement of the connector a second distance in the first direction moves the at least one of the pistons with the actuator.

14. The foam dispenser of claim 13, wherein the connector has a U-shaped body comprising the attachment portion and a lip portion for connection to the piston, and wherein the flexible portion extends outward from an end of the U-shaped body.

15. The foam dispenser of claim 14, wherein the lip portion of the U-shaped body pushes against a first projection of the at least one of the pistons to move the at least one of the pistons in a first direction when the connector is linked to the at least one of the pistons and the restrictor is not positioned between the flexible portion of the connector and the at least one of the pistons.

16. The foam dispenser of claim 15, wherein the flexible portion comprises a plurality of flexible members that extend inward and towards the at least one of the pistons when the connector is linked to the at least one of the pistons without the restrictor in place, and wherein the connector pushes against a second projection of the at least one of the pistons to move the at least one of the pistons in a second direction when the connector is linked to the at least one of the pistons without the restrictor in place.

17. The foam dispenser of claim 16, wherein the flexible members comprise at least one slot formed on an interior of the flexible members, and wherein the restrictor comprises at least one plate inserted in the at least one slot slot of the flexible members.

* * * * *